US006652229B2

(12) United States Patent
Lu

(10) Patent No.: US 6,652,229 B2
(45) Date of Patent: Nov. 25, 2003

(54) LEAF SEAL SUPPORT FOR INNER BAND OF A TURBINE NOZZLE IN A GAS TURBINE ENGINE

(75) Inventor: Wenfeng Lu, Mason, OH (US)

(73) Assignee: General Electric Company, Schenectady, NY (US)

( * ) Notice: Subject to any disclaimer, the term of this patent is extended or adjusted under 35 U.S.C. 154(b) by 93 days.

(21) Appl. No.: 10/085,185

(22) Filed: Feb. 27, 2002

(65) Prior Publication Data

US 2003/0161726 A1 Aug. 28, 2003

(51) Int. Cl.[7] ..... F01D 9/04
(52) U.S. Cl. ..... 415/190; 415/173.3
(58) Field of Search ..... 415/190, 209.2, 415/115, 173.3; 277/176

(56) References Cited

U.S. PATENT DOCUMENTS

| | | | | |
|---|---|---|---|---|
| 5,118,120 | A | 6/1992 | Drerup et al. | 277/176 |
| 5,333,443 | A | 8/1994 | Halila | 60/39.31 |
| 5,797,723 | A | 8/1998 | Frost et al. | 415/174.2 |
| 5,848,854 | A | 12/1998 | Brackett | 403/327 |
| 6,199,871 | B1 | 3/2001 | Lampes | 277/614 |

*Primary Examiner*—Edward K. Look
*Assistant Examiner*—Kimya N McCoy
(74) *Attorney, Agent, or Firm*—William Scott Andes; James P. Davidson

(57) ABSTRACT

A turbine nozzle assembly for a gas turbine engine, including: a plurality of segments joined together to form an outer band; a plurality of segments joined together to form an inner band; at least one airfoil positioned between the outer and inner bands; a leaf seal attached to each inner band segment by at least one pin member; and, a leaf seal attached to each outer band segment by at least one pin member. Each of the inner band segments includes a protrusion extending from a surface thereof so as to provide balanced support to the corresponding leaf seal in conjunction with the pin members. Each of the inner band segments further includes a first portion having a flange extending therefrom, a second portion opposite the first portion, a first end, and a second end opposite the first end, wherein the surface extends between the first and second ends and the first and second portions.

20 Claims, 4 Drawing Sheets

LEAF SEAL SUPPORT FOR INNER BAND OF A TURBINE NOZZLE IN A GAS TURBINE ENGINE

BACKGROUND OF THE INVENTION

The present invention relates generally to a turbine nozzle for a gas turbine engine and, in particular, to the balanced support of leaf seals to an inner band of such turbine nozzle.

It will be appreciated that a nozzle for the high pressure turbine of a gas turbine engine is provided in order to receive the active flowpath gas stream at the exit of the combustor and turn such gas stream to meet the spinning rotor of the high pressure turbine. The turbine nozzle is typically made up of a plurality of segments to form an annulus, where each segment includes an outer band, an inner band, and one or more hollow airfoils positioned therebetween. In order to provide separation between the hot gas stream and a cooling flow located both radially inside and outside of the turbine nozzle, leaf seals have been installed on the inner and outer bands. This has been accomplished more recently by means of loading pins in conjunction with pre-loaded springs, as seen, for example, in U.S. Pat. No. 5,797,723 to Frost et al. In this way, the leaf seals are retained in position without any gap between the leaf seal and nozzle.

While loaded springs have been demonstrated to be an effective solution to the problem of loosely installed seals, it has been found that such leaf seals are not supported in balance due to the configuration of the nozzle and the positioning of the loading pins in a non-symmetrical manner. Accordingly, cantilever loading forces are imposed upon the leaf seals. Under some circumstances, the uneven loading combined with vibration and pressure fluctuation could cause liberation of the leaf seal. It will be appreciated that once the seal liberates, the back flow margin on the leading edge of that particular vane will decrease, causing a weak cooling flow, or even back flow, to the vane. Furthermore, if the broken leaf seal happens to block the insert inlet of the band, and greatly limits the cooling supply, the vane will be under elevated temperature and fail quickly.

Thus, in light of the foregoing, it would be desirable for an improved turbine nozzle design to be developed which provides balanced support of the leaf seals at the inner and outer nozzle bands without affecting performance and reliability of the turbine nozzle. It would also be desirable that minimal changes to the components of existing turbine nozzles be required so that those turbine nozzles in the field may be easily altered to provide the desired support to the leaf seals.

BRIEF SUMMARY OF THE INVENTION

In a first exemplary embodiment of the invention, a segment of an annular band utilized to support a turbine nozzle of a gas turbine engine is disclosed as including a first end and a second end opposite thereof, a flange portion extending between the first and second ends, a second portion extending between the first and second ends opposite the flange portion, a surface extending between the first and second ends and the flange and second portions, wherein at least one inlet is formed therein, at least one lug positioned adjacent the flange portion for receiving a pin to attach a leaf seal to the band segment, and at least one protrusion extending from the surface to assist in providing balanced support to a leaf seal attached to the band segment.

In a second exemplary embodiment of the invention, a turbine nozzle assembly for a gas turbine engine is disclosed as including a plurality of segments joined together to form an outer band, a plurality of segments joined together to form an inner band, at least one airfoil positioned between the outer and inner bands, a leaf seal attached to each inner band segment by at least one pin member, and a leaf seal attached to each outer band segment by at least one pin member. Each inner band segment includes a protrusion extending from a surface thereof so as to provide balanced support to the corresponding leaf seal in conjunction with the pin members. Each of the inner band segments further includes a first portion having a flange extending therefrom, a second portion opposite the first portion, a first end, and a second end opposite the first end, wherein the surface extends between the first and second ends and the first and second portions.

DETAILED DESCRIPTION OF THE INVENTION

Figure 1:
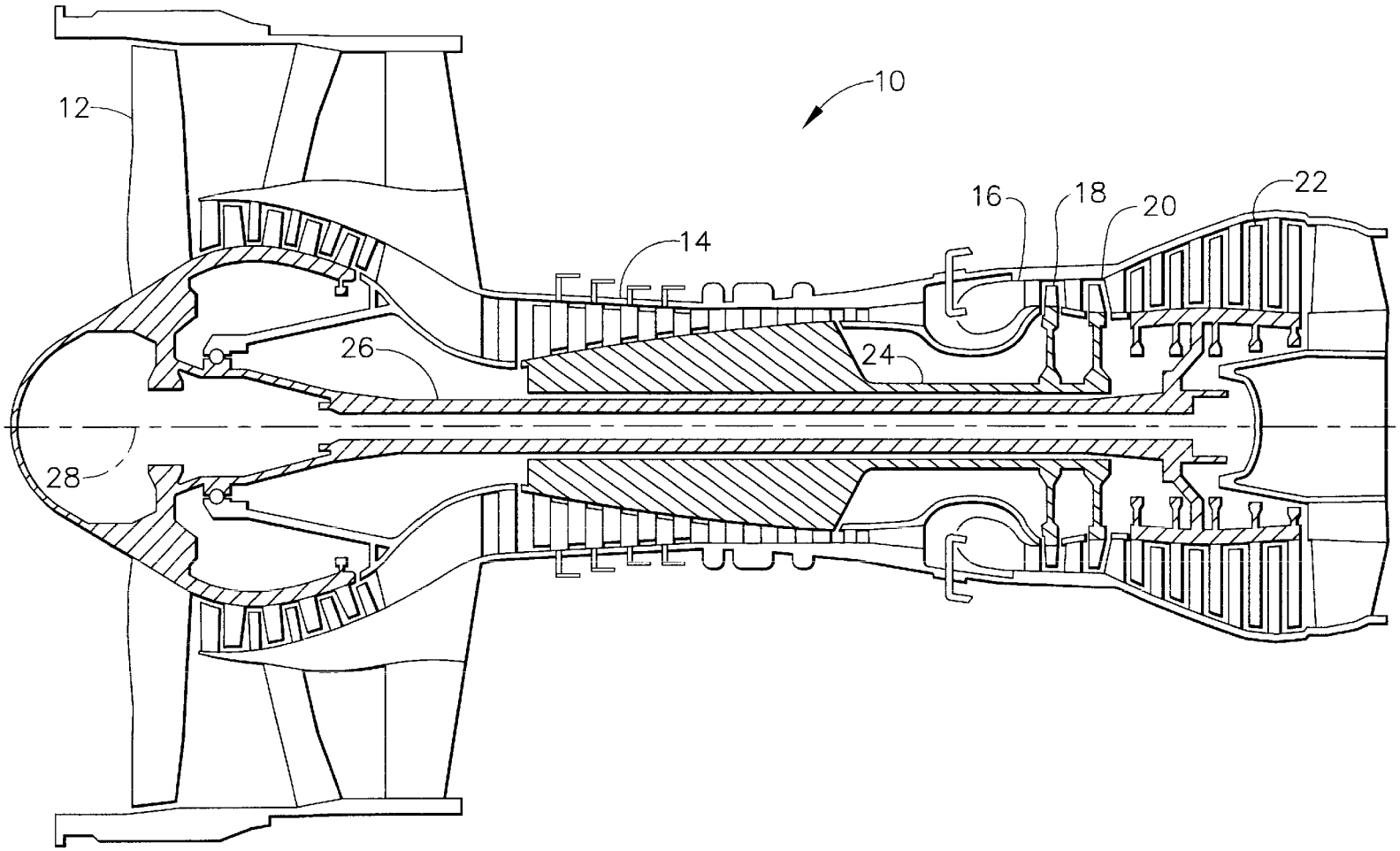
FIG. 1 is a cross-sectional view of a gas turbine engine including a turbine nozzle in accordance with the present invention.

Referring now to the drawings in detail, wherein identical numerals indicate the same elements throughout the figures, FIG. 1 depicts an exemplary turbofan gas turbine engine 10 having in serial flow communication a conventional fan 12, a high pressure compressor 14, and a combustor 16. Combustor 16 conventionally generates combustion gases that are discharged therefrom through a high pressure turbine nozzle assembly 18, from which the combustion gases are channeled to a conventional high pressure turbine 20 and, in turn, to a conventional low pressure turbine 22. High pressure turbine 20 drives high pressure compressor 14 through a suitable shaft 24, while low pressure turbine 22 drives fan 12 through another suitable shaft 26, all disposed coaxially about a longitudinal or axial centerline axis 28.

Figure 2:
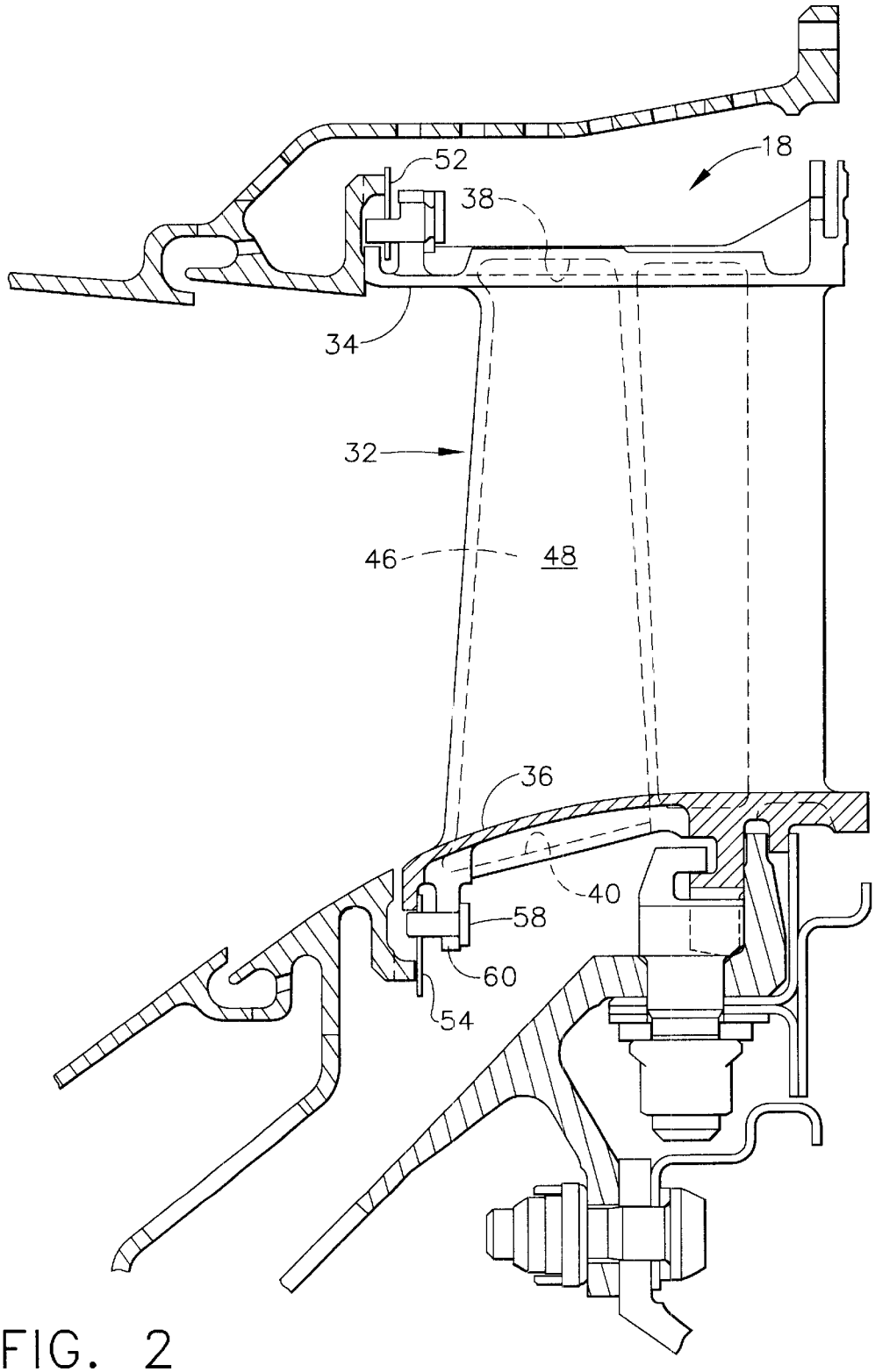
FIG. 2 is an enlarged, partial cross-sectional view of the turbine nozzle depicted in FIG. 1.
Figure 3:
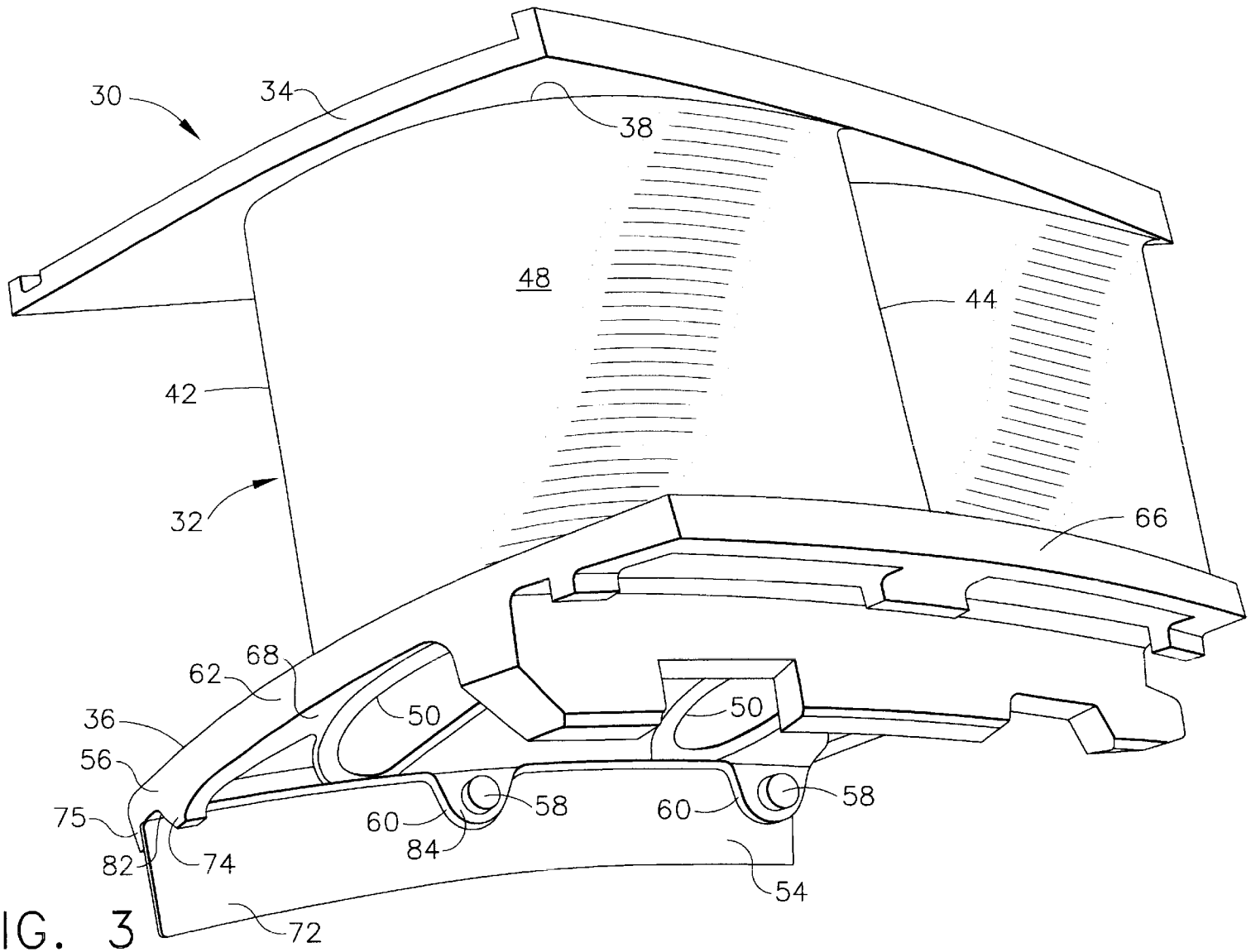
FIG. 3 is a bottom perspective view of a segment of the turbine nozzle depicted in FIG. 2 including an inner band portion in accordance with the present invention.
Figure 4:
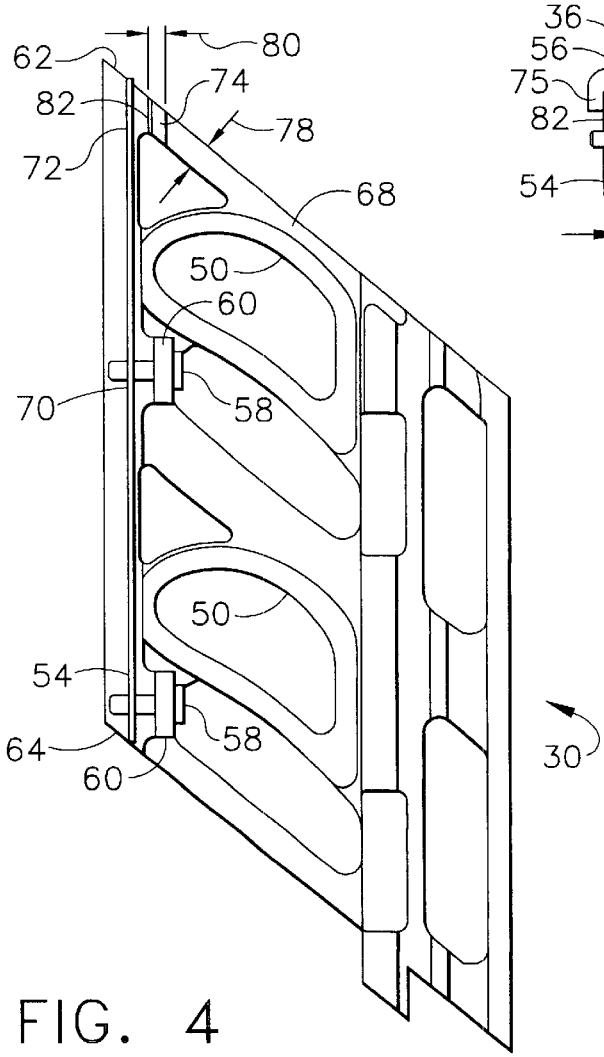
FIG. 4 is an end view of the turbine nozzle segment depicted in FIG. 3; and, FIG. 5 is a side view of the turbine nozzle segment depicted in FIGS. 3 and 4.

Referring now to FIGS. 2 and 3, it will be understood that turbine nozzle 18 preferably includes a plurality of circumferentially adjoining nozzle segments 30 to a collectively form a complete 360° assembly. Each nozzle segment 30 preferably has two or more circumferentially spaced airfoils 32 which are connected to an arcuate radially outer band segment 34 and an arcuate radially inner band segment 36. More specifically, each airfoil 32 includes an outer side wall 38 whose surface lies adjacent to outer band segment 34, an inner side wall 40 whose surface lies adjacent to inner band segment 36, a leading edge 42 extending from outer side wall 38 to inner side wall 40, a trailing edge 44 extending from outer side wall 38 to inner side wall 40, a concave surface 46 extending from leading edge 42 to trailing edge 44 on a pressure side of airfoil 32, and a convex surface 48 extending from leading edge 42 to trailing edge 44 on a suction side of airfoil 32. A plurality of insert inlets 50 are provided within inner band segment 36 (see FIGS. 3 and 4), as well as in outer band segment 34 (not shown), so that air is supplied to the interior of airfoils 32 for cooling.

It will further be seen that leaf seals 52 and 54 are attached adjacent to a forward or upstream portion of each outer band segment 34 and each inner band segment 36, respectively. More specifically, as seen with respect to each inner band segment 36 in FIGS. 3 and 4, leaf seal 54 preferably is attached to a first portion 56 (also known as an upstream or forward portion) of inner band segment 36 by means of at least one pin member 58 being positioned through leaf seal 54 and retained within a corresponding lug 60. Each inner band segment 36 includes a first end 62 and a second end 64, with first portion 56 extending between first and second ends 62 and 64, a second portion 66 (also known as a downstream or aft portion) positioned opposite first portion 56 and extending between first and second ends 62 and 64, and a surface 68 extending between first and second ends 62 and 64 and first and second portions 56 and 66.

It will be appreciated that surface 68 is not continuous since insert inlets 50 are provided therethrough. Accordingly, lugs 60 are typically positioned adjacent one of first and second ends 62 and 64 and at a midpoint 70 in an asymmetrical arrangement since such areas have provided material upon which to locate such lugs 60. This has caused certain cantilever forces to be imposed upon an end 72 of leaf seal 54 where no pin/lug connection is present, such as during low power operation of gas turbine engine 10. As indicated herein, such cantilever forces, along with vibration and pressure fluctuation, can cause liberation of leaf seal 54. In order to prevent this from occurring, the present invention involves the placement of at least one protruding member 74, otherwise known herein as a protrusion, extending from surface 68 so as to provide balanced support of leaf seal 54 in conjunction with pin members 58. In order to accomplish this function, protrusion 74 preferably is spaced substantially equidistantly with respect to pin members 58 and lugs 60 so as to be substantially symmetrical across inner band segment 36.

Figure 5:
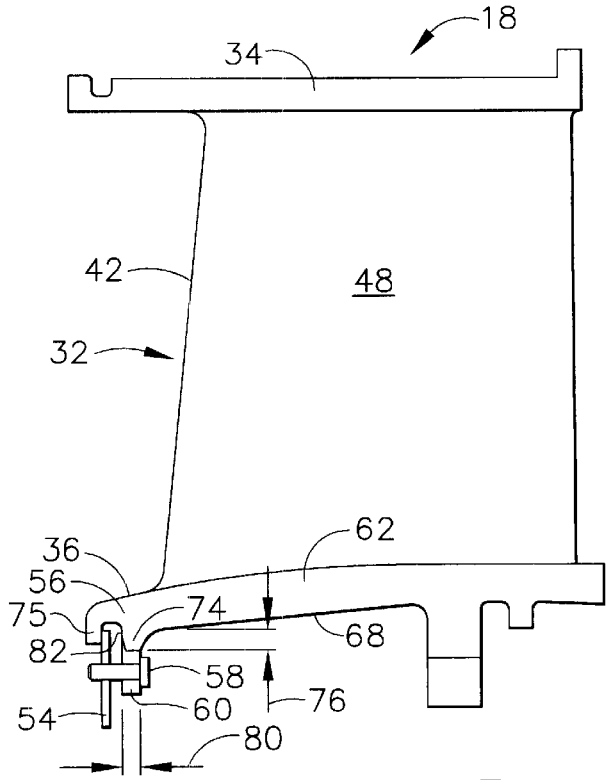

It will be seen from FIGS. 3 and 5 that first portion 56 of inner band segment 36 includes a flange 75 extending therefrom. Leaf seal 54 is positioned generally against flange 75, which prevents leaf seal 54 from moving in a first (upstream) direction but not in an opposite (downstream) direction when the aforementioned cantilever forces are applied thereto. Accordingly, protrusion 74 is preferably located on surface 68 in a predetermined spaced relationship with flange 75 so as to restrict leaf seal 54 from moving in a direction away from flange 75 more than a specified amount. It will be appreciated that protrusion 74 has a thickness 76 so that it extends a predetermined distance from surface 68, as seen in FIG. 5. Protrusion 74 will preferably have a predetermined width 78, whereby it will extend a predetermined amount in a first direction across surface 68 toward the opposite end. Likewise, protrusion 74 will preferably have a predetermined length 80, whereby it will extend a predetermined amount in a second direction across surface 68 toward second portion 66.

While protrusion 74 can have any number of configurations or shapes (e.g., rectangular, triangular, or polygonal) and still serve the purpose of providing support to leaf seal 54, protrusion 74 preferably includes a portion 82 located nearest flange 75 which has a substantially flat surface in substantially parallel relation with flange 75. In order to balance weight considerations against the performance of protrusion 74, it is preferred that the flat surface of portion 82 have a surface area less than the surface area of a lug surface 84 and preferably approximately 25–50% of such lug surface 84. It will further be appreciated that the weight of protrusion 74 is minimal in comparison to the overall weight of inner band segment 36.

In order to position protrusion 74 on surface 68 of inner band segments 36, it will be understood that such protrusion 74 can be cast thereon as an integral part thereof. Alternatively, for those turbine nozzle segments 30 already in service, protrusion 74 may be attached to surface 68 by means of welding, brazing, or other similar processes.

Having shown and described the preferred embodiment of the present invention, further adaptations of turbine nozzle segments 30, and specifically inner band segments 36 and protrusions 74, can be accomplished by appropriate modifications by one of ordinary skill in the art without departing from the scope of the invention. In particular, it will be understood that the concepts described and claimed herein could be utilized with respect to outer band segments 34 or at various positions along inner and outer band segments 36 and 34, respectively, and still be compatible with the present invention.

What it claimed is:

1. A segment of an annular band utilized to support a turbine nozzle of a gas turbine engine, comprising:

(a) a first end and a second end opposite thereof;

(b) a flange portion extending between said first and second ends;

(c) a second portion extending between said first and second ends opposite said flange portion;

(d) a surface extending between said first and second ends and said flange and second portions, wherein at least one inlet is formed therein;

(e) at least one lug positioned at a predetermined circumferential location adjacent said flange portion for receiving a pin to attach a leaf seal to said band segment; and (f) at least one protrusion extending from said surface at a predetermined circumferential location to assist in providing balanced support to a led seal attached to said band segment.

2. The band segment of claim 1, wherein said protrusion is located on said surface adjacent one of said fist and second ends so as to restrict movement of said leaf seal more than a predetermined amount under the influence of cantilever forces on said leaf seal.

3. The band segment of claim 1, wherein said protrusion is located on said surface in a predetermined spaced relationship with said flange portion of said band segment.

4. The band segment of claim 1, wherein said protrusion extends a predetermined amount from said surface.

5. The band segment of claim 1, wherein said protrusion includes a portion having a substantially flat surface in substantially parallel relation with said flange portion.

6. The band segment of claim 5, wherein said substantially flat surface portion of said protrusion has a surface area approximately 25–50% of a surface for said lug.

7. The band segment of claim 1, wherein said protrusion extends a predetermined amount in a first direction across said surface.

8. The band segment of claim 1, wherein said protrusion extends a predetermined amount in a second direction across said surface toward said second portion.

9. The band segment of claim 1, wherein said protrusion is cast onto said surface as an integral part of said band segment.

10. The band segment of claim 1, wherein said protrusion is attached to said surface of said band segment.

11. The band segment of claim 1, wherein said protrusion has a predetermined shape.

12. The band segment of claim 1, wherein said protrusion is spaced equidistantly in a circumferential direction with respect to said pin lugs so as to be substantially symmetrically positioned across said segment from said first end to said second end.

13. The band segment of claim 1, wherein said band segment is for en inner band of said turbine nozzle.

14. The band segment of claim 1, wherein said band segment is for an outer band of said turbine nozzle.

15. A turbine nozzle assembly for a gas turbine engine, comprising:

(a) a plurality of segments joined together to form an outer band;

(b) a plurality of segments joined together to form an inner band;

(c) at least one airfoil positioned between said outer and inner bands;

(d) a leaf seal attached to each said inner band segment by at least one pin member; and (e) a leaf seal attached to each said outer band segment by at least one pin member;

wherein each of said inner band segments includes a protrusion extending from a surface at a predetermined circumferential location thereof so as to provide balanced support to said corresponding leaf seal in conjunction with said pin members.

16. The turbine nozzle assembly of claim 15, each of said inner band segments comprising:

(a) a first portion having a flange extending therefrom;

(b) a second portion opposite said first portion;

(c) a first end; and (d) a second end opposite said first end;

wherein said surface extends between said first and second ends and said first and second portions.

17. The turbine nozzle assembly of claim 16, wherein said protrusion is located on said surface adjacent one of said first and second ends so as to provide support against cantilever forces on a leaf seal attached to said inner band segment.

18. The turbine nozzle assembly of claim 16, wherein said protrusion is located on said surface in a predetermined spaced relationship with said first portion of said inner band segment.

19. The turbine nozzle assembly of claim 16, wherein said protrusion includes a portion having a substantially flat surface in substantially parallel relation with said first portion flange.

20. The turbine nozzle assembly of claim 16, said inner band segment including at least one lug positioned adjacent said first portion in a predetermined circumferential location for receiving a pinto attach said leaf seal to said inner band segment, wherein said protrusion is spaced with respect to said pin lugs so as to be substantially symmetrically positioned circumferentially across said inner band segment from said first end to said second end.

* * * * *